US010498032B2

(12) United States Patent
Kuang et al.

(10) Patent No.: US 10,498,032 B2
(45) Date of Patent: Dec. 3, 2019

(54) ANTENNA COMPONENT AND ELECTRONIC DEVICE

(71) Applicant: Xiaomi Inc., Haidian District, Beijing (CN)

(72) Inventors: Wei Kuang, Beijing (CN); Youquan Su, Beijing (CN); Wendong Liu, Beijing (CN)

(73) Assignee: XIAOMI INC., Beijing (CN)

( * ) Notice: Subject to any disclaimer, the term of this patent is extended or adjusted under 35 U.S.C. 154(b) by 385 days.

(21) Appl. No.: 15/385,076

(22) Filed: Dec. 20, 2016

(65) Prior Publication Data

US 2017/0187112 A1 Jun. 29, 2017

(30) Foreign Application Priority Data

Dec. 26, 2015 (CN) ..... 2015 1 0997796

(51) Int. Cl.
*H01Q 5/35* (2015.01)
*H01Q 1/48* (2006.01)
*H01Q 1/24* (2006.01)

(52) U.S. Cl.
CPC ..... *H01Q 5/35* (2015.01); *H01Q 1/243* (2013.01); *H01Q 1/48* (2013.01)

(58) Field of Classification Search
CPC ..... H01Q 1/243; H01Q 5/35
See application file for complete search history.

(56) References Cited

U.S. PATENT DOCUMENTS 6,400,336 B1 6/2002 Gleener
9,236,659 B2 * 1/2016 Vazquez ..... H01Q 13/103
9,762,710 B2 * 9/2017 Lee ..... H01Q 1/243
2015/0048979 A1 2/2015 Asrani et al.
2015/0084824 A1 3/2015 Montgomery
2015/0200448 A1 7/2015 Tsai et al.
2015/0200463 A1 7/2015 Heikura et al.
2015/0270610 A1 9/2015 Kodama
2016/0351997 A1 * 12/2016 Wu ..... H01Q 1/243

FOREIGN PATENT DOCUMENTS

CN 104022349 A 9/2014
CN 104795643 A 7/2015
CN 204720561 U 10/2015
CN 105098369 A 11/2015
WO 2011018551 A1 2/2011

OTHER PUBLICATIONS

Communication pursuant to Article 94(3) EPC Issued in corresponding European Application No. 16205072.8, dated May 7, 2018, 10 pages.
International Search Report issued in corresponding International Application No. PCT/CN2016/100080, dated Jan. 3, 2017, 12 pages.
Extended European Search Report issued in corresponding EP Application No. 16205072.8, dated Apr. 28, 2017, 10 pages.

* cited by examiner

*Primary Examiner* — Jessica Han
*Assistant Examiner* — Amal Patel
(74) *Attorney, Agent, or Firm* — Arch & Lake LLP

(57) ABSTRACT

An antenna and an electronic device are disclosed, which relates to an antenna. The antenna component includes an antenna body, two feed circuits, and at least one ground circuit. The two feed circuits are connected to the antenna body through respective feed points. The at least one ground circuit is connected to the antenna body through respective one of ground points, and at least one of the ground points is located between the two feed points.

12 Claims, 5 Drawing Sheets

ANTENNA COMPONENT AND ELECTRONIC DEVICE

CROSS-REFERENCE TO RELATED APPLICATION

This application is based on and claims priority to Chinese Patent Application No. 201510997796.7 filed on Dec. 26, 2015, which is incorporated herein by reference in its entirety.

TECHNICAL FIELD

The present disclosure relates to an antenna, and particularly to an antenna component and an electronic device.

BACKGROUND

With the development of manufacturing technique of electronic devices, more and more electronic devices have employed a metallic back cover. In comparison with a plastic back cover, the metallic back cover has a better appearance and a better touch. However, sometimes, the bottom metallic back cover may be designed as a single antenna to cover whole frequency bands. Such design may cause the poor performance of the antenna and negatively affect the carrier aggregation.

SUMMARY

An antenna component and an electronic device are provided in the disclosure. A method of providing an antenna component is also provided in the present disclosure.

According to a first aspect of embodiments in the disclosure, an antenna component is provided. The antenna component may include an antenna body, two feed circuits, and at least one ground circuit; where the two feed circuits are connected to the antenna body through respective feed points; and the at least one ground circuit is connected to the antenna body through respective one of ground points, and at least one ground point of the ground points is located between the two feed points.

According to a second aspect of embodiments in the disclosure, an electronic device is provided. The electronic device may include an antenna component which may include an antenna body, two feed circuits, and at least one ground circuit; where the two feed circuits are connected to the antenna body through respective feed points; and the at least one ground circuit is connected to the antenna body through respective one of ground points, and at least one ground point of the ground points is located between the two feed points.

A method of providing an antenna component is provided. The method may include providing an antenna component comprising: an antenna body, two feed circuits, and at least one ground circuit, where the two feed circuits are connected to the antenna body through respective feed points; and connecting the at least one ground circuit to the antenna body through respective one of ground points, where at least one ground point of the ground points is located between the two feed points.

It is to be understood that both the forgoing general description and the following detailed description are exemplary only, and are not restrictive of the present disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

Figure 1:
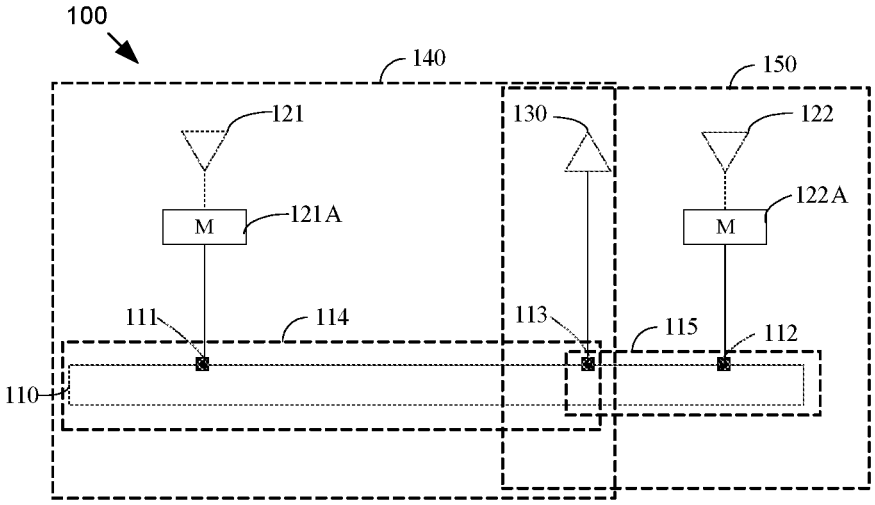
FIG. 1 is a schematic structure diagram of an antenna component illustrated in one exemplary embodiment of the disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Reference will now be made in detail to exemplary embodiments, examples of which are illustrated in the accompanying drawings. The following description refers to the accompanying drawings in which same numbers in different drawings represent same or similar elements unless otherwise described. The implementations set forth in the following description of exemplary embodiments do not represent all implementations consistent with the disclosure. Instead, they are merely examples consistent with aspects related to the disclosure as recited in the appended claims.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may include used herein to describe various information, the information should not be limited by these terms. These terms are only used to distinguish one category of information from another. For example, without departing from the scope of the present disclosure, first information may include termed as second information; and similarly, second information may also be termed as first information. As used herein, the term "if" may include understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may include combined in any suitable manner.

The metallic back cover may have negative impact for an antenna to receive signals. In order to reduce the impact on receiving an antenna signal from using the metallic back cover, a segmented metallic back cover is formed by slitting the metallic back cover, and the bottom metallic back cover of the segmented metallic back cover may be used as an antenna to radiate signals. However, sometimes, the bottom metallic back cover may be designed as a single antenna to cover whole frequency bands. Such design may cause a poor performance of the antenna and create the negative impact on carrier aggregation.

An antenna and an electronic device are disclosed in present disclosure that relates to an antenna. The antenna component includes an antenna body, two feed circuits, and at least one ground circuit. The two feed circuits are connected to the antenna body through respective feed points. The at least one ground circuit is connected to the antenna body through respective one of ground points, and at least one of the ground points is located between the two feed points. The disclosed antenna solves the problem that the bottom metallic back cover is designed as a single antenna to cover the whole frequency bands in a related technology, resulting in a poor performance of the antenna and a disadvantage to the carrier aggregation. The same antenna body is utilized to form two antennas, and the two antennas are employed to implement a coverage for the whole frequency bands, thus the antenna performance of each antenna is ensured, and the double-antenna structure is beneficial for the carrier aggregation of a broadband.

Referring to FIG. 1, a schematic structure diagram of an antenna component 100 illustrated in one exemplary embodiment of the disclosure is shown. The antenna component includes an antenna body, two feed circuits, and at least one ground circuit.

As shown in FIG. 1, the antenna component 100 includes an antenna body 110, a first feed circuit 121, a second feed circuit 122, and a first ground circuit 130.

A first feed point 111 and a second feed point 112 may be disposed on the antenna body 110. The first feed circuit 121 may be electrically connected to the antenna body 110 through the first feed point 111, and the second feed circuit 122 may be electrically connected to the antenna body 110 through the second feed point 112.

A first ground point 113 may be further disposed on the antenna body 110, and it may be located between the first feed point 111 and the second feed point 112. The first ground circuit 130 may be electrically connected to the antenna body 110 through the first ground point 113.

The antenna body 110 may be segmented into a left antenna body 114 and a right antenna body 115 by the first ground point 113. A first antenna 140 may be formed by the first feed circuit 121, the first ground circuit 130, and the left antenna body 114. A second antenna 150 may be formed by the second feed circuit 122, the first ground circuit 130, and the right antenna body 115. The first antenna 140 and the second antenna 150 may be used to cover the whole frequency bands (from 700 MHz to 2700 MHz), and operation frequency bands of the first antenna 140 and the second antenna 150 may be isolated from each other.

In FIG. 1, the first feed circuit 121 further includes a first match circuit 121A, and the second feed circuit 122 further includes a second match circuit 122A. The first match circuit 121A and the second match circuit 122A are used for impedance matching in order to improve radiant efficiency of the first antenna 140 and the second antenna 150.

In the antenna component provided by the embodiment, one ground circuit is disposed on an antenna body, and each of both sides of the ground circuit is disposed with one feed circuit, thus two antennas are formed on the same antenna body to cover the whole frequency bands. As a result, the problem that the bottom metallic back cover is designed as a single antenna to cover the whole frequency bands, resulting in a poor performance of the antenna and a disadvantage to the carrier aggregation, may be solved. Also, two antennas are formed with the same antenna body, and the two antennas are employed to implement a coverage for the whole frequency bands, thus the antenna performance of each antenna can be ensured, and the double-antenna structure is beneficial for the carrier aggregation of a broad band.

Figure 2A:
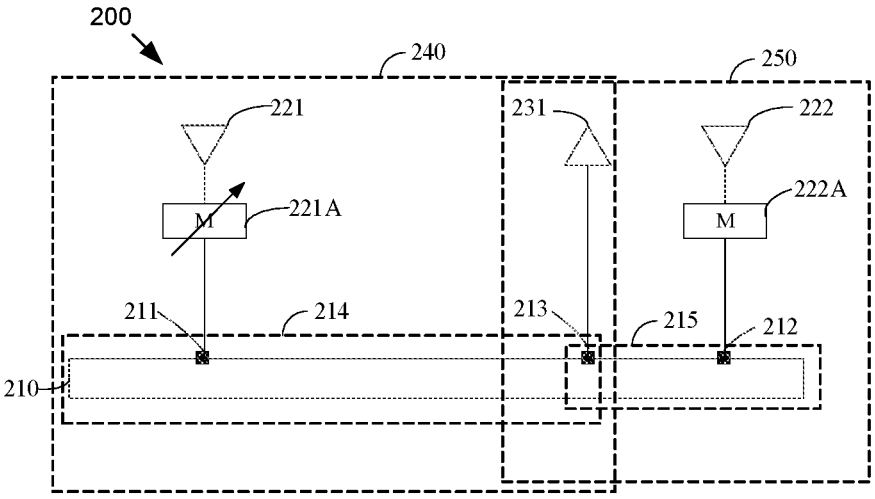
FIG. 2A is a schematic structure diagram of an antenna component illustrated in another exemplary embodiment of the disclosure.

Referring to FIG. 2A, a schematic structure diagram of an antenna component 200 illustrated in another exemplary embodiment of the disclosure is shown. The antenna component 200 includes an antenna body 210, a first feed circuit 221, a second feed circuit 222, and a first ground circuit 231.

A first feed point 211 and a second feed point 212 may be disposed on the antenna body 210. The first feed circuit 221 may be electrically connected to the antenna body 210 through the first feed point 211, and the second feed circuit 222 may be electrically connected to the antenna body 210 through the second feed point 212.

When the antenna component 200 is in operation, a feed current is transmitted to the antenna body 210 through the first feed point 211 from the first feed circuit 221, and a feed current is transmitted to the antenna body 210 through the second feed point 212 from the second feed circuit 222.

A first ground point 213 may be further disposed on the antenna body 210, and it may be located between the first feed point 211 and the second feed point 212. The first ground circuit 231 may be electrically connected to the antenna body 210 through the first ground point 213.

As shown in FIG. 2A, the antenna body 210 may be segmented into a left antenna body 214 and a right antenna body 215 by the first ground point 213, and the first feed point 211 may be located on the left antenna body 214, and the second feed point 212 may be located on the right antenna body 215.

A first antenna 240 is formed by the first feed circuit 221, the first ground circuit 231, and the left antenna body 214, and a second antenna 250 is formed by the second feed circuit 222, the first ground circuit 231, and the right antenna body 215. As shown in FIG. 2A, in the antenna component 200, the first antenna 240 and the second antenna 250 may be both inverted-F antennas. The first antenna 240 and the second antenna 250 may also be other types of antennas, such as a loopback antenna (in the case that the first feed circuit 221 and the second feed circuit 222 are both on the edge of the antenna body 210), and the like. The types of the first antenna and the second antenna are not limited to the embodiment of the disclosure.

In order to enable the formed first antenna 240 and the second antenna 250 to jointly cover the whole frequency bands (from 700 MHz to 2700 MHz), and to avoid interference between the first antenna 240 and the second antenna 250 when the first antenna 240 and the second antenna 250 are in operation at the same time, the first antenna 240 and the second antenna 250 are designed to cover different frequency bands.

As shown in FIG. 2A, the distance between the first feed point 211 and the first ground point 213 is longer than the distance between the second feed point 212 and the first ground point 213. When the antenna component 200 is in operation, the length of the antenna body 210 participating in the radiation of the first antenna 240 is greater than the length of the antenna body 210 participating in the radiation of the second antenna 250, therefore, in comparison with the second antenna 250, the first antenna 240 may be able to cover a lower-frequency band.

In one possible implementation, the first antenna 240 may be designed to cover a low-frequency band and a middle-frequency band, and keep a good radiation performance and radiation efficiency in the low-frequency band and middle-frequency band; correspondingly, the second antenna 250 may be designed to cover a high-frequency band, and keep a good radiation performance and radiation efficiency in the high-frequency band. In another possible implementation, the first antenna 240 may be designed to cover a low-frequency band and a high-frequency band, and keep a good radiation performance and radiation efficiency in the low-frequency band and high-frequency band; correspondingly, the second antenna 250 may be designed to cover a middle-frequency band, and keep a good radiation performance and radiation efficiency in the middle-frequency band.

Alternatively, the band coverage may be altered in the middle of the operation. The band coverage may be changed for different time intervals. For example, during a first time interval, the first antenna 240 covers the low-frequency band and middle-frequency band, and the second antenna 250 covers a high-frequency band, and during a second time interval, the first antenna 240 covers the low-frequency band and high-frequency band, and the second antenna 250 covers a middle-frequency band.

The band coverage may also be changed for different radiations. For example, in one radiation instance, the first antenna 240 covers the low-frequency band and middle-frequency band and the second antenna 250 covers a high-frequency band, and for another radiation instance, the first antenna 240 covers the low-frequency band and high-frequency band, and the second antenna 250 covers a middle-frequency band.

In addition, the band coverage for the first antenna 240 and the second antenna 250 may be configured to cover the same frequency range to improve the radiation throughput. For example, both first antenna 240 and the second antenna 250 may be configured to cover a high-frequency band at the same time to improve the radiation efficiency for the high-frequency band.

The range of the low-frequency band may be from 700 MHz to 960 MHz, the range of the middle-frequency band may be from 1710 MHz to 2170 MHz, and the range of the high-frequency band may be from 2300 MHz to 2700 MHz. Other divisions for the frequency ranges are possible. In general, a frequency corresponding to the low-frequency band less than a frequency corresponding to the middle-frequency band, and less than a frequency corresponding to the high-frequency band.

With the antenna structure as shown in FIG. 2A, the first antenna 240 and the second antenna 250 may be able to operate at the same time, and thus jointly cover the whole frequency bands, since the first antenna 240 and the second antenna 250 may operate respectively on different frequency bands which may be highly isolated. Furthermore, the first antenna 240 and the second antenna 250 may be able to keep a good radiation performance and radiation efficiency in respectively covered frequency bands, and to support a broad bandwidth, which is beneficial for the antenna component 200 to implement various combinations of carrier aggregation (low-frequency band+middle-frequency band, low-frequency band+high-frequency band, middle-frequency band+high-frequency band, and low-frequency band+middle-frequency band+high-frequency band).

In the antenna component provided in the embodiment, one ground circuit is disposed on an antenna body, and each of both sides of the ground circuit is disposed with one feed circuit, thus two antennas are formed on the same antenna body to cover the whole frequency bands. As a result, the problem that the bottom metallic back cover is designed as a single antenna to cover the whole frequency bands in the related technology, resulting in a poor performance of the antenna and a disadvantage to the carrier aggregation, may be solved. Also, two antennas are formed with the same antenna body, and the two antennas are employed to implement a coverage for the whole frequency bands, thus the antenna performance of each antenna is ensured, and the double-antenna structure is beneficial for the carrier aggregation for a broad band.

In this embodiment, the double-antenna structure is implemented on the same antenna body, and the two antennas cover different frequency bands respectively, so that the interference between the two antennas is small when the two antennas are in operation at the same time. Also, each antenna may be able to keep a high radiation performance and radiation efficiency in a corresponding frequency band, and support a broad bandwidth, which is beneficial for the double-antenna structure to implement various combinations of carrier aggregation.

As shown in FIG. 2A, the first feed circuit 221 further includes a first match circuit 221A, and the second feed circuit 222 further includes a second match circuit 222A. When the antenna component 200 is in operation, the first match circuit 221A and the second match circuit 222A may perform the antenna impedance match respectively, so that the first antenna 240 and the second antenna 250 are both able to keep a high radiation efficiency.

The first match circuit 221A may be an adjustable match circuit, which is to provide at least two low-frequency states for low-frequency band coverage.

Figure 2B:
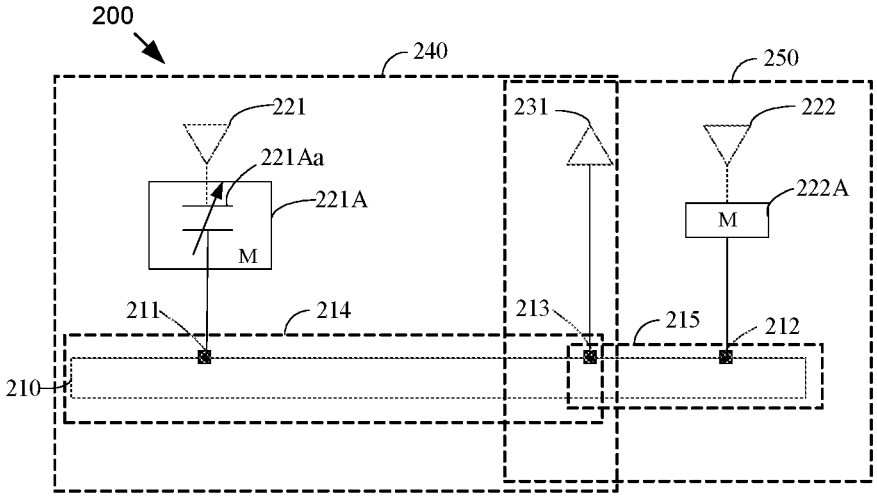
FIG. 2B is a schematic structure diagram of a first match circuit in the antenna component shown in FIG. 2A.

As shown in FIG. 2B, the first match circuit 221A may include a capacitor 221Aa which provides at least two capacitance values, that is, the capacitor 221Aa is an adjustable capacitor. The capacitance value of the capacitor 221Aa may be adjusted by the first match circuit 221A to switch between different low-frequency states.

For example, the capacitor 221Aa may provide two capacitance values, namely, a first capacitance value and a second capacitance value. When the capacitor 221Aa is adjusted to the first capacitance value by the first match circuit 221A, the first antenna 240 may operate in a first low-frequency state, and the frequency corresponding to the first low-frequency state may be 700 MHz. When the capacitor 221Aa is adjusted to the second capacitance value by the first match circuit 221A, the first antenna 240 may operate in a second low-frequency state, and the frequency corresponding to the second low-frequency state may be 900 MHz.

When the first antenna 240 operates in the first low-frequency state (700 MHz state), the radiation efficiency and radiation performance at 700 MHz are both better than the radiation efficiency and radiation performance at 700 MHz when the first antenna 240 operates in the second low-frequency state (900 MHz state). Similarly, when the first antenna 240 operates in the second low-frequency state (900 MHz state), the radiation efficiency and radiation performance at 900 MHz are both better than the radiation efficiency and radiation performance at 900 MHz when the first antenna 240 operates in the first low-frequency state (700 MHz state). Therefore, when the first antenna 240 needs to operate at 700 MHz, the capacitor 221Aa may be adjusted to the first capacitance value by the first match circuit 221A, so that the first antenna 240 may operate in the first low-frequency state, and thus an efficient radiation of the first antenna 240 at 700 MHz can be achieved. When the first antenna 240 needs to operate at 900 MHz, the capacitor 221Aa may be adjusted to the second capacitance value by the first match circuit 221A, so that the first antenna 240 may operate in the second low-frequency state, and thus an efficient radiation of the first antenna 240 at 900 MHz can be achieved.

When the capacitor 221Aa is included in the first match circuit 221A, the frequency corresponding to each low-frequency state is in inverse proportion to the capacitance value of the capacitor 221Aa. The greater the capacitance value of the capacitor 221Aa is, the lower the frequency corresponding to the low-frequency state provided by the first antenna 240 is; and conversely, the smaller the capacitance value of the capacitor 221Aa is, the higher the frequency corresponding to the low-frequency state provided by the first antenna 240 is.

Figure 2C:
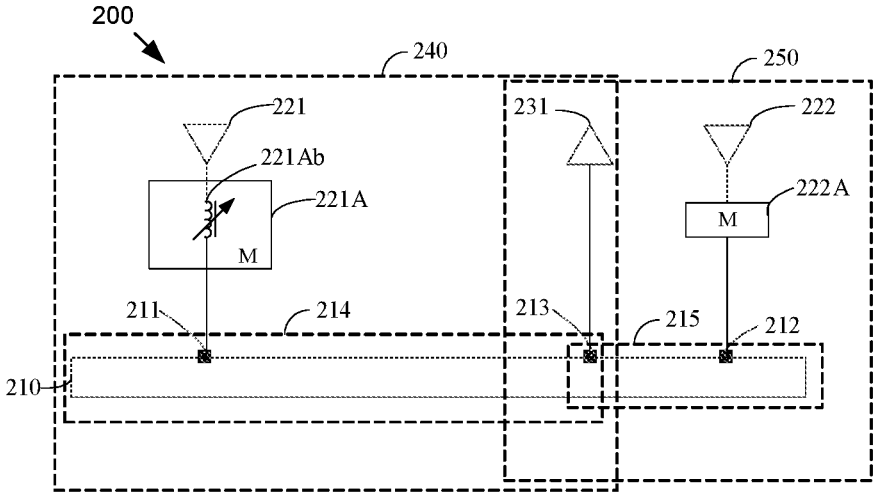
FIG. 2C is a schematic structure diagram of a first match circuit in the antenna component shown in FIG. 2A.

In another possible implementation, as shown in FIG. 2C, the first match circuit 221A may further include an inductor 221Ab which provides at least two inductance values, that is, the inductor 221Ab may be an adjustable inductor, and the inductance value of the inductor 221Ab may be adjusted by the first match circuit 221A to switch between different low-frequency states.

When the inductor 221Ab is included in the first match circuit 221A, the frequency corresponding to each low-frequency state is in inverse proportion to the inductance value of the inductor 221Ab. The greater the inductance value of the inductor 221Ab is, the lower the frequency corresponding to the low-frequency state provided by the first antenna 240 is; and conversely, the smaller the inductance value of the inductor 221Ab is, the higher the frequency corresponding to the low-frequency state provided by the first antenna 240 is.

As mentioned in the implementation, the first match circuit 221A may include an adjustable capacitor (or an adjustable inductor), and the capacitance value (or inductance value) of the adjustable capacitor (or the adjustable inductor) is adjusted to switch between different low-frequency states, which is merely an example for illustration. In other possible implementations, the first match circuit 221A may further include other electronic elements to implement the switch between different low-frequency states. The disclosure is not limited in this respect.

In this embodiment, an adjustable capacitor (or an adjustable inductor) is disposed in the first match circuit, and the capacitance value (or inductance value) of the adjustable capacitor (or the adjustable inductor) is adjusted to obtain different low-frequency states. As a result, a number of states can be achieved by using the adjustable capacitor (or the adjustable inductor) to cover the whole low-frequency bands, and the bandwidth corresponding to each state may be broad. The fewer states may be beneficial for the carrier aggregation of a broadband.

Figure 2D:
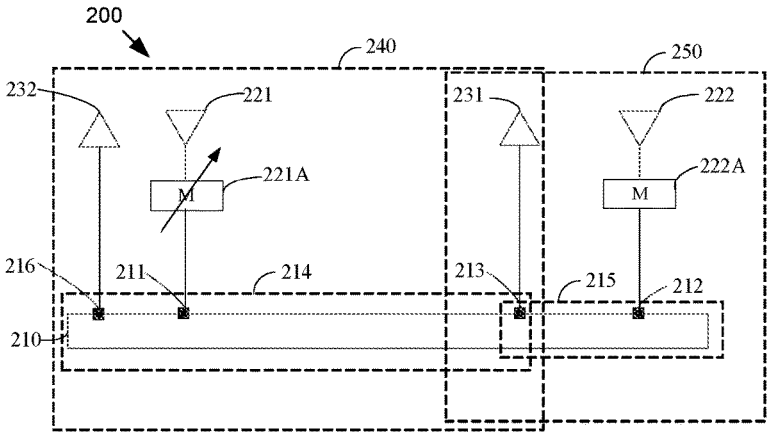
FIG. 2D is a schematic structure diagram of an antenna component illustrated in yet another exemplary embodiment of the disclosure.

Based on FIG. 2A, the antenna component 200 may further include a second ground circuit 232, in order to further improve the antenna isolation between the first antenna 240 and the second antenna 250 to reduce the antenna interference when the first antenna 240 and the second antenna 250 are in operation at the same time, as shown in FIG. 2D.

The second ground circuit 232 is electrically connected to the antenna body 210 through a second ground point 216, which may be located on the left antenna body 214. It is also possible that the second ground circuit 232 locates on the other position on the antenna body. When the antenna component 200 is in operation, the second ground circuit 232 is utilized to improve the antenna isolation between the first antenna 240 and the second antenna 250 when they are in operation at the same time.

When the antenna component 200 is a bottom metallic back cover of a segmented metallic back cover which may include a top metallic back cover and the bottom metallic back cover, the ground modes of the first ground circuit 231 and the second ground circuit 232 include but are not limited to: providing a pogo pin against the top metallic back cover, providing an elastic piece against the top metallic back cover, and shorting with the top metallic back cover with metal at the slit.

In this embodiment, the antenna isolation between the first antenna and the second antenna is improved by adding an additional ground point on the left antenna body, thus the antenna interference is reduced when the first antenna and the second antenna are in operation at the same time, and the operation stability of the antenna component is further improved.

Figure 3A:
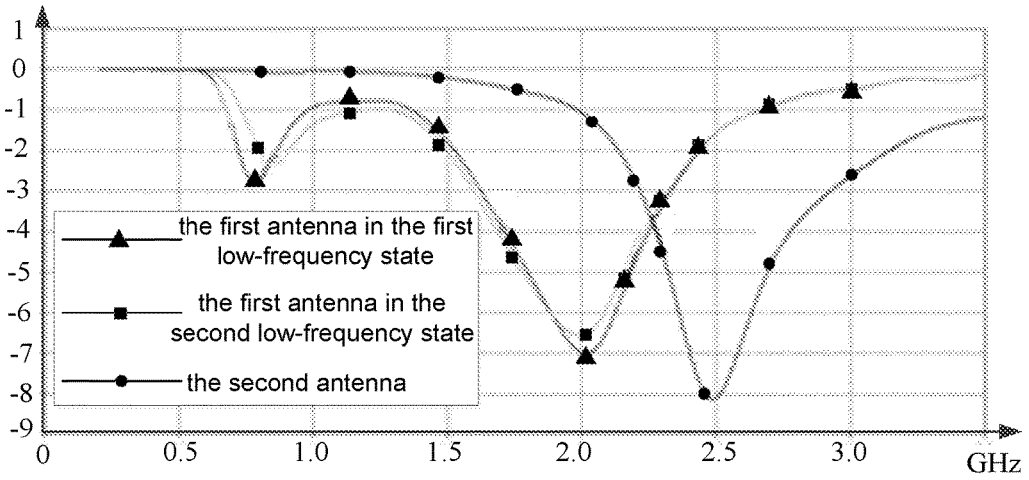
FIG. 3A is an S11 curve diagram of a first antenna and a second antenna in the antenna component shown in FIG. 2A.
Figure 3B:
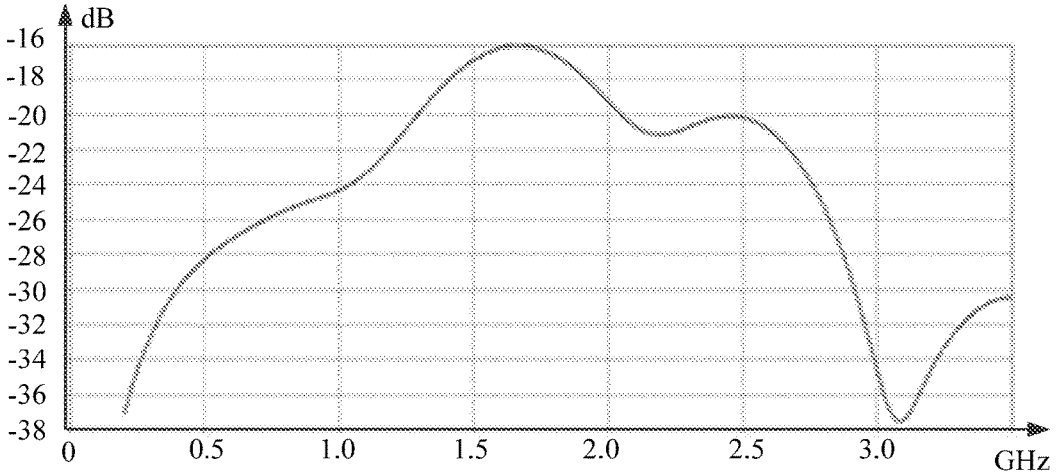
FIG. 3B is an antenna isolation curve diagram for a first antenna and a second antenna in the antenna component shown in FIG. 2A.
Figure 3C:
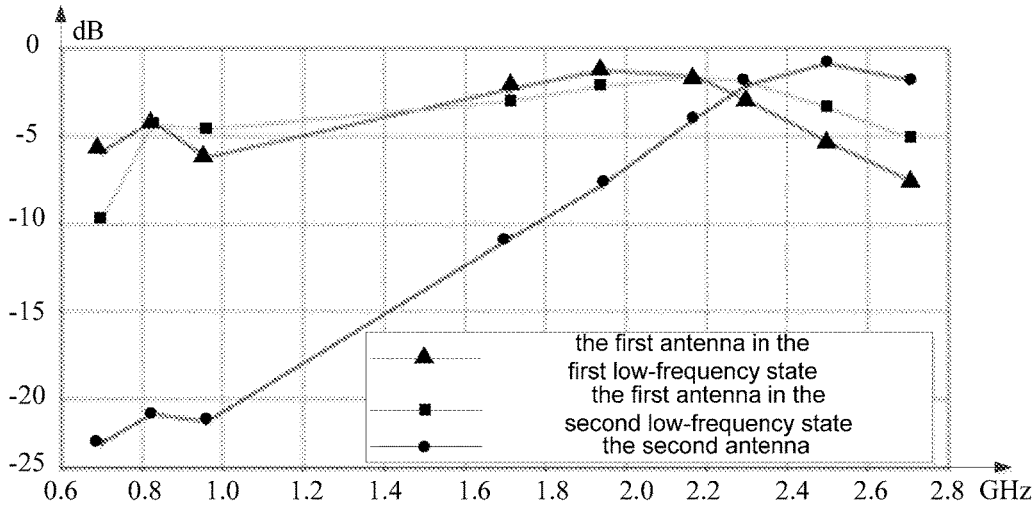
FIG. 3C is an efficiency curve diagram of a first antenna and a second antenna in the antenna component shown in FIG. 2A.

FIG. 3A is an S11 curve diagram of the first antenna and the second antenna in the antenna component shown in FIG. 2A. FIG. 3B is an antenna isolation curve diagram of the first antenna and the second antenna in the antenna component shown in FIG. 2A. FIG. 3C is an efficiency curve diagram of the first antenna and the second antenna in the antenna component shown in FIG. 2A. As illustrated in FIG. 3C, the first antenna is to cover the low-frequency band and the middle-frequency band, the second antenna is to cover the high-frequency band, and the first low-frequency state and the second low-frequency state are both utilized to cover the low-frequency band by the first antenna.

With the antenna component 200 shown in FIG. 2A, the first antenna and the second antenna may be able to cover the whole frequency bands (from 700 MHz to 2700 MHz), and the first antenna may be able to cover the whole low-frequency band (from 700 MHz to 960 MHz) with a number of low-frequency states (two in this embodiment). Mean-while, since the bandwidth corresponding to each low-frequency state of the first antenna is broad, it is beneficial for the antenna component 200 to implement various combinations of carrier aggregation (low-frequency band+middle-frequency band, low-frequency band+high-frequency band, middle-frequency band+high-frequency band, and low-frequency band+middle-frequency band+high-frequency band).

In general, S11 represents how much power is reflected from the antenna, and hence is known as the reflection coefficient. For example, if S11=0 dB, then all the power is reflected from the antenna and nothing is radiated. If S11=−10 dB, this implies that if 3 dB of power is delivered to the antenna, −7 dB is the reflected power. The remainder of the power was "accepted by" or delivered to the antenna. This accepted power is either radiated or absorbed as losses within the antenna. Since antennas are typically designed to be low loss, ideally the majority of the power delivered to the antenna is radiated.

As shown in FIG. 3A and FIG. 3C, at the frequency point of 700 MHz, the S11 value corresponding to the first low-frequency state is better than the S11 value corresponding to the second low-frequency state, and the efficiency value corresponding to the first low-frequency state is higher than the efficiency value corresponding to the second low-frequency state, that is, at the frequency point of 700 MHz, the radiation performance and the radiation efficiency corresponding to the first low-frequency state are better than those corresponding to the second low-frequency state.

At the frequency point of 900 MHz, the S11 value corresponding to the second low-frequency state is better than the S11 value corresponding to the first low-frequency state, and the efficiency value corresponding to the second low-frequency state is higher than the efficiency value corresponding to the first low-frequency state, that is, at the frequency point of 900 MHz, the radiation performance and the radiation efficiency corresponding to the second low-frequency state are better than those corresponding to the first low-frequency state. Therefore, the first match circuit may be controlled to switch to an appropriate low-frequency state by an electronic device configured with the antenna component 200 shown in FIG. 2A according to current operation frequency, thus the radiation performance and the radiation efficiency of the antenna component 200 in the low-frequency band may be improved.

Also, as shown in FIG. 3B, the antenna isolation between the first antenna and the second antenna is greater than 16 dB, thus a small interference between the first antenna and the second antenna exists and operation stability is ensured when they are in operation at the same time.

In conclusion, the antenna component 200 shown in FIG. 2A is in good performance, easy to be manufactured (with the structure including a single antenna radiator, two feed circuits and one ground circuit), and low-cost. Furthermore, the antenna component 200 may be able to cover the whole low-frequency band with fewer states, which is beneficial for the carrier aggregation of a broadband.

Figure 4:
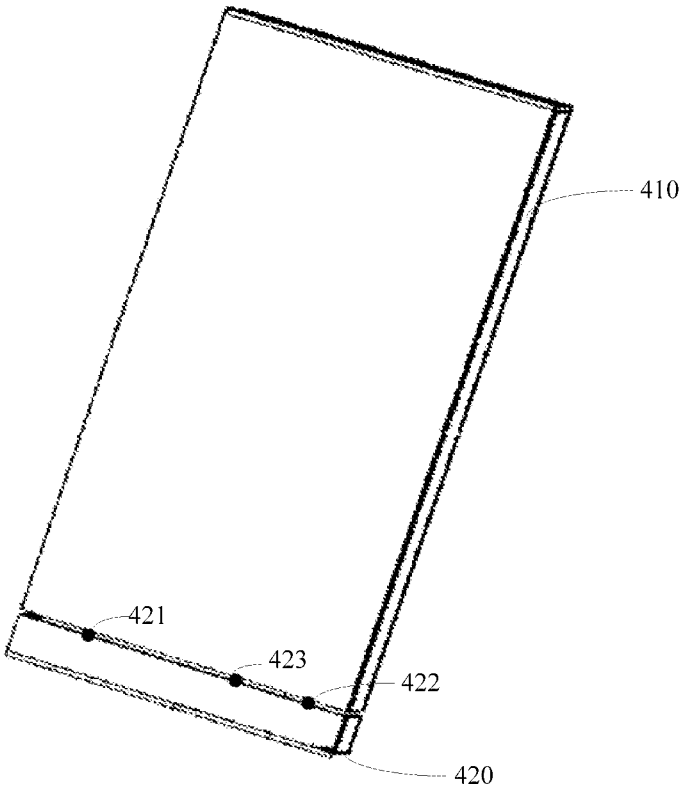
FIG. 4 is a schematic structure diagram of an electronic device provided in one exemplary embodiment of the disclosure.

As shown in FIG. 4, a schematic structure diagram of an electronic device illustrated in one exemplary embodiment of the disclosure is shown. The electronic device with a metallic back cover including an antenna component shown in any embodiment described above is taken as an example by this embodiment for illustration.

As shown in FIG. 4, the back cover of the electronic device is a segmented metallic back cover including two segments, namely, a top metallic back cover 410 and a bottom metallic back cover 420 respectively. The antenna body included in the antenna component provided by the embodiment described above is the bottom metallic back cover 420. A first feed point 421, a second feed point 422 and a first ground point 423 are disposed on the bottom metallic back cover 420.

The first feed point 421 may be connected to a first feed terminal of a PCB (Printed Circuit Board) within the electronic device through a feed line. Similarly, the second feed point 422 may be connected to a second feed terminal of the PCB within the electronic device through a feed line.

The first ground point 423 may be connected to a ground terminal of the PCB within the electronic device, and also may be connected with the top metallic back cover 410 (equivalent to be grounded). The disclosure is not limited in this respect.

An example of a method disclosed in the present disclosure may include providing an antenna component having an antenna body, two feed circuits, and at least one ground circuit, where the two feed circuits are connected to the antenna body through respective feed points; and connecting the at least one ground circuit to the antenna body through respective one of ground points, wherein at least one ground point of the ground points is located between the two feed points.

Further, the method may also include providing a first feed circuit of the two feed circuits where the first feed circuit is connected to the antenna body through a first feed point; providing a second feed circuit of the two feed circuits where the second feed circuit is connected to the antenna body through a second feed point; providing a first ground circuit which is connected to the antenna body through a first ground point, where the first ground point is located between the first feed point and the second feed point, and where the first ground point divides the antenna body into a left antenna body and a right antenna body, where the first feed point is located on the left antenna body, and the second feed point is located on the right antenna body; providing a first antenna that is formed by the first feed circuit, the first ground circuit, and the left antenna body; and providing a second antenna is formed by the second feed circuit, the first ground circuit, and the right antenna body.

The method provided herein may be part a process to making or using the antenna component which may be part of an electronic device.

Other embodiments of the disclosure will be apparent to those skilled in the art from consideration of the specification and practice of the disclosures herein. This application is intended to cover any variations, uses, or adaptations of the disclosure following the general principles thereof and including common sense or customary technical means in the art that is not disclosed in the disclosure. It is intended that the specification and examples be considered as exemplary only, with a true scope and spirit of the disclosure being indicated by the following claims.

It will be appreciated that the inventive concept is not limited to the exact construction that has been described above and illustrated in the accompanying drawings, and that various modifications and changes can be made without departing from the scope thereof. It is intended that the scope of the disclosure is only limited by the appended claims.

What is claimed is:

1. An antenna component, comprising:

an antenna body, two feed circuits, and only two ground circuits; wherein the two feed circuits are connected to the antenna body through respective feed points, the two feed circuits comprising a first feed circuit and a second feed circuit; and the two ground circuits are connected to the antenna body through respective ground points, the two ground circuits comprising a first ground circuit and a second ground circuit, wherein the first feed circuit is connected to the antenna body through a first feed point, the second feed circuit is connected to the antenna body through a second feed point, and the first ground circuit is connected to the antenna body through a first ground point, the first ground point being located between the first feed point and the second feed point; wherein the first ground point divides the antenna body into a left antenna body and a right antenna body, the first feed point being located on the left antenna body, and the second feed point being located on the right antenna body;

a first antenna is formed by the first feed circuit, the first ground circuit, and the left antenna body; a second antenna is formed by the second feed circuit, the first ground circuit, and the right antenna body; the first ground circuit is shared between the first antenna and the second antenna; and the second ground circuit is connected to the antenna body through a second ground point, wherein the second ground point, which is located on the left antenna body and on a side of the first feed point away from second feed point, is to separate the first antenna from the second antenna.

2. The antenna component of claim 1, wherein a first distance between the first feed point and the first ground point is longer than a second distance between the second feed point and the first ground point; and wherein the first antenna is to cover a low-frequency band and a middle-frequency band, and the second antenna is to cover a high-frequency band;

or, the first antenna is to cover the low-frequency band and the high-frequency band, and the second antenna is to cover the middle-frequency band;

wherein, the low-frequency band is from 700 MHz to 960 MHz, the middle-frequency band is from 1710 MHz to 2170 MHz, and the high-frequency band is from 2300 MHz to 2700 MHz.

3. The antenna component of claim 1 wherein the first feed circuit comprises a first match circuit;

the second feed circuit comprises a second match circuit; and wherein the first match circuit and the second match circuit are adjustable for impedance matching.

4. The antenna component of claim 3, wherein the first match circuit is further to provide at least two low-frequency states to cover the low-frequency band; and the first match circuit, which comprises an inductor providing at least two inductance values, is to switch the at least two low-frequency states by adjusting the inductance values of the inductor; and wherein a frequency corresponding to one of the at least two low-frequency states is in inverse proportion to the inductance values.

5. The antenna component of claim 3, wherein the first match circuit is further to provide at least two low-frequency states to cover the low-frequency band; and the first match circuit, which comprises a capacitor providing at least two capacitance values, is to switch the at least two low-frequency states by adjusting the capacitance values of the capacitor; and wherein a frequency corresponding to one of the at least two low-frequency states is in inverse proportion to the capacitance values.

6. An electronic device comprising an antenna component, wherein the antenna component comprises:

an antenna body, two feed circuits, and only two ground circuits; wherein the two feed circuits are connected to the antenna body through respective feed points, the two feed circuits comprising a first feed circuit and a second feed circuit; and the two ground circuits are connected to the antenna body through respective ground points, and the two ground circuits comprising a first ground circuit and a second ground circuit, wherein the first feed circuit is connected to the antenna body through a first feed point, the second feed circuit is connected to the antenna body through a second feed point, and the first ground circuit is connected to the antenna body through a first ground point, the first ground point being located between the first feed point and the second feed point; wherein the first ground point divides the antenna body into a left antenna body and a right antenna body, the first feed point being located on the left antenna body, and the second feed point being located on the right antenna body;

a first antenna is formed by the first feed circuit, the first ground circuit, and the left antenna body; a second antenna is formed by the second feed circuit, the first ground circuit, and the right antenna body; the first ground circuit is shared between the first antenna and the second antenna; and the second ground circuit is connected to the antenna body through a second ground point, wherein the second ground point, which is located on the left antenna body and on a side of the first feed point away from second feed point, is to separate the first antenna from the second antenna.

7. The electronic device of claim 6, wherein a first distance between the first feed point and the first ground point is longer than a second distance between the second feed point and the first ground point; and wherein the first antenna is to cover a low-frequency band and a middle-frequency band, and the second antenna is to cover a high-frequency band;

or, the first antenna is to cover the low-frequency band and the high-frequency band, and the second antenna is to cover the middle-frequency band;

wherein, the low-frequency band is from 700 MHz to 960 MHz, the middle-frequency band is from 1710 MHz to 2170 MHz, and the high-frequency band is from 2300 MHz to 2700 MHz.

8. The electronic device of claim 6, wherein the first feed circuit comprises a first match circuit;

the second feed circuit comprises a second match circuit; and wherein the first match circuit and the second match circuit are adjustable for impedance matching.

9. The electronic device of claim 8, wherein the first match circuit is further to provide at least two low-frequency states to cover the low-frequency band; and the first match circuit, which comprises an inductor providing at least two inductance values, is to switch the at least two low-frequency states by adjusting the inductance values of the inductor; and wherein a frequency corresponding to one of the at least two low-frequency states is in inverse proportion to the inductance values.

10. The electronic device of claim 8, wherein the first match circuit is further to provide at least two low-frequency states to cover the low-frequency band; and the first match circuit, which comprises a capacitor providing at least two capacitance values, is to switch the at least two low-frequency states by adjusting the capacitance values of the capacitor; and wherein a frequency corresponding to one of the at least two low-frequency states is in inverse proportion to the capacitance values.

11. The electronic device of claim 6, wherein a back cover of the electronic device is a segmented metallic back cover, and the antenna body is a bottom metallic back cover of the segmented metallic back cover.

12. A method, comprising providing an antenna component comprising: an antenna body, two feed circuits, and only two ground circuits, wherein the two feed circuits are connected to the antenna body through respective feed points, the two feed circuits comprising a first feed circuit and a second feed circuit; and connecting the two ground circuits to the antenna body through respective ground points, wherein the two ground circuits comprise a first ground circuit and a second ground circuit, connecting the first feed circuit to the antenna body through a first feed point;

connecting the second feed circuit to the antenna body through a second feed point;

connecting the first ground circuit to the antenna body through a first ground point, wherein the first ground point is located between the first feed point and the second feed point; wherein the first ground point divides the antenna body into a left antenna body and a right antenna body, the first feed point being located on the left antenna body, and the second feed point being located on the right antenna body;

providing a first antenna that is formed by the first feed circuit, the first ground circuit, and the left antenna body; providing a second antenna that is formed by the second feed circuit, the first ground circuit, and the right antenna body; the first ground circuit is shared between the first antenna and the second antenna; and connecting the second ground circuit to the antenna body through a second ground point, wherein the second ground point, which is located on the left antenna body and on a side of the first feed point away from second feed point, is to separate the first antenna from the second antenna.

* * * * *